US006619405B2

(12) United States Patent
Theurer et al.

(10) Patent No.: US 6,619,405 B2
(45) Date of Patent: Sep. 16, 2003

(54) BALLAST CLEANING MACHINE AND METHOD

(75) Inventors: Josef Theurer, Vienna (AT); Herbert Wörgötter, Gallneukirchen (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 0 days.

(21) Appl. No.: 10/098,277

(22) Filed: Mar. 15, 2002

(65) Prior Publication Data

US 2002/0157282 A1 Oct. 31, 2002

(30) Foreign Application Priority Data

May 9, 2001 (AT) ..... 363/2001 U
Apr. 25, 2001 (AT) ..... 321/2001 U

(51) Int. Cl.[7] ..... E01B 27/10; E01B 35/02
(52) U.S. Cl. ..... 171/16; 37/104; 104/7.3
(58) Field of Search ..... 37/104, 105, 106, 37/107; 171/16; 104/2, 7.3, 5, 7.1, 12

(56) References Cited

U.S. PATENT DOCUMENTS 5,513,452 A * 5/1996 Theurer et al. ..... 37/104
6,189,224 B1 2/2001 Theurer et al. ..... 33/338

FOREIGN PATENT DOCUMENTS

| | | |
|---|---|---|
| DE | 240 043 | 8/1985 |
| DE | 43 43 148 | 10/1994 |
| EP | 0 629 744 | 5/1994 |
| FR | 714 645 | 7/1930 |
| FR | 1029167 | 12/1950 |

* cited by examiner

*Primary Examiner*—Christopher J. Novosad
(74) *Attorney, Agent, or Firm*—Collard & Roe, P.C.

(57) ABSTRACT

A ballast cleaning machine comprises a first machine frame and a second, trailing machine frame linked thereto. Ends of the machine frames are supported on the track by undercarriages for movement of the machine in an operating direction. A vertically and laterally adjustable endless excavating chain as well as a track lifting device is mounted on each machine frame. An upper layer of the ballast bed is excavated by the first excavating chain, the track is lowered to the remaining ballast bed layer, and the remaining ballast bed layer is immediately thereafter excavated by the second excavating chain. The excavated ballast is cleaned in a common screening installation, and the cleaned ballast is distributed at a trailing end of the second machine frame to the ballast bed.

8 Claims, 2 Drawing Sheets

BALLAST CLEANING MACHINE AND METHOD

BACKGROUND OF THE INVENTION

1. Field of the Invention

The present invention relates to a machine for cleaning ballast excavated from a ballast bed supporting a track, the machine being movable on the track in an operating direction, which comprises two vertically and laterally adjustable endless excavating chains sequentially mounted in the operating direction on the machine and passing underneath the track for excavating the ballast, track lifting means on the machine, a screening installation for cleaning the excavated ballast, a conveyor arrangement for conveying the excavated ballast to the screening installation, and another conveyor arrangement for conveying the cleaned ballast from the screening installation to a ballast distributing device for distributing the cleaned ballast to the ballast bed. This invention is also directed to a novel bllast cleaning method.

2. Description of the Prior Art

Ballast cleaning machines of this type have been disclosed in published German paent application No. 43 43 148 A1, French patent No. 1,029,167 and German Democratic Republic patent No. 240 043. These machines have a machine frame supported on undercarriages at the ends of the machine frame for movement on the track in an operating direction, and two excavating chains are mounted on the machine frame immediately following each other in the operating direction. A ballast cleaning screening installation is arranged between the two ballast excavating chains. While the machine continuously advances along the track, the first excavating chain, as seen in the operating direction, excavates the ballast and conveys it to the screening installation, and the second, trailing excavating chain removes the soil underlying the ballast bed. The removed soil is conveyed to trailing storage cars. Before the cleaned ballast is distributed from the screening installation, a protective sand layer is laid on the subgrade.

French patent No. 714,645 shows an arrangement of four endless bucket chains for raising excavated ballast and convey it to a screening installation.

Another machine for rehabilitating a ballast bed is disclosed in European patent application No. 0 629 744 B1. A first excavating chain excavates a layer of ballast, and the excavated ballast is comminuted in a stone crusher. The comminuted ballast is distributed on the excavated ballast bed and compacted to serve as a protective layer over the subgrade. A second excavating chain mounted on a second machine frame removes soil, which is replaced by the protective layer, whereupon the track is laid. In a subsequent operating stage, new ballast is introduced to provide a ballast bed.

SUMMARY OF THE INVENTION

It is the primary object of this invention to provide a ballast cleaning machine of the first-described type and a ballast cleaning method to enhance the ballast cleaning efficiency.

The above and other objects are accomplished according to one aspect of the invention with a machine for cleaning ballast excavated from a ballast bed supporting a track, the machine being movable on the track in an operating direction, which comprises a first machine frame, and a second machine frame trailing the first machine frame in the operating direction and linked thereto, the ends of the machine frames being supported on the track by undercarriages. A first vertically and laterally adjustable endless excavating chain is mounted on the first machine frame and passes underneath the track for excavating the ballast, a first track lifting device is mounted on the first machine frame, a second vertically and laterally adjustable endless excavating chain is mounted on the second machine frame and passes underneath the track for excavating the ballast, and a second track lifting device is mounted on the second machine frame. The machine further comprises a screening installation for cleaning the excavated ballast, a first conveyor arrangement for conveying the excavated ballast from the first excavating chain to the screening installation, a second conveyor arrangement for conveying the excavated ballast from the second excavating chain to the screening installation, a ballast distributing device arranged at a trailing end of the second machine frame for distributing ballast cleaned on the screening installation to the ballast bed, and a third conveyor arrangement for conveying the cleaned ballast from the screening installation to the ballast distributing device, the third conveyor arrangement having a discharge end behind the second excavating chain in the operating direction and an inlet end arranged to receive the cleaned ballast from the screening installation.

According to another aspect, the present invention provides a method for cleaning ballast excavated from a ballast bed supporting a track, which comprises a first cleaning stage wherein an upper layer of the ballast bed is excavated, the excavated ballast is cleaned and the track is lowered to lay on the remaining layer of the ballast bed, a second and trailing cleaning stage immediately following the first cleaning stage, wherein the track is lifted, the ballast of the remaining layer of the ballast bed is excavated and the excavated ballast is cleaned, and the ballast cleaned in the first and second cleaning stages is distributed to the ballast bed before the track is lowered to lie on a cleaned ballast bed.

While the apparatus and method of this invention require a short temporary positioning of the track on an interim level of the excavated track, the ballast cleaning efficiency is considerably enhanced without requiring high constructural expenditures. Such high costs in constructing the machine would be involved if the two endless excavating chains were mounted on a common machine frame since the distance between the two undercarriages at the ends of such a common frame would have to be very large to permit a permissible flexing of the track. For this reason, the prior art preferred increasing the capacity of the screening installation and of the ballast excavating chains to obtain enhanced efficiency.

In a preferred embodiment, the ballast cleaning machine comprises vertically adjustable and vibratory ballast compacting devices for compacting the ballast at the shoulders of the ballast bed, the ballast compacting devices being mounted on the first machine frame at a rear end thereof where an undercarriage supports the machine frame on the track. In this way, the track position is temporarily stabilized during the short period of time before the cleaned ballast is distributed to the ballast bed so that the two undercarriages between the first and second ballast excavating chains may move on the track without problems.

BRIEF DESCRIPTION OF THE DRAWING

The above and other objects, features and advantages of the invention will become more apparent from the following detailed description of a now preferred embodiment thereof, taken in conjunction with the accompanying drawing showing the ballast cleaning machine, in which.

DETAILED DESCRIPTION OF THE PREFERRED EMBODIMENT

Figure 1:
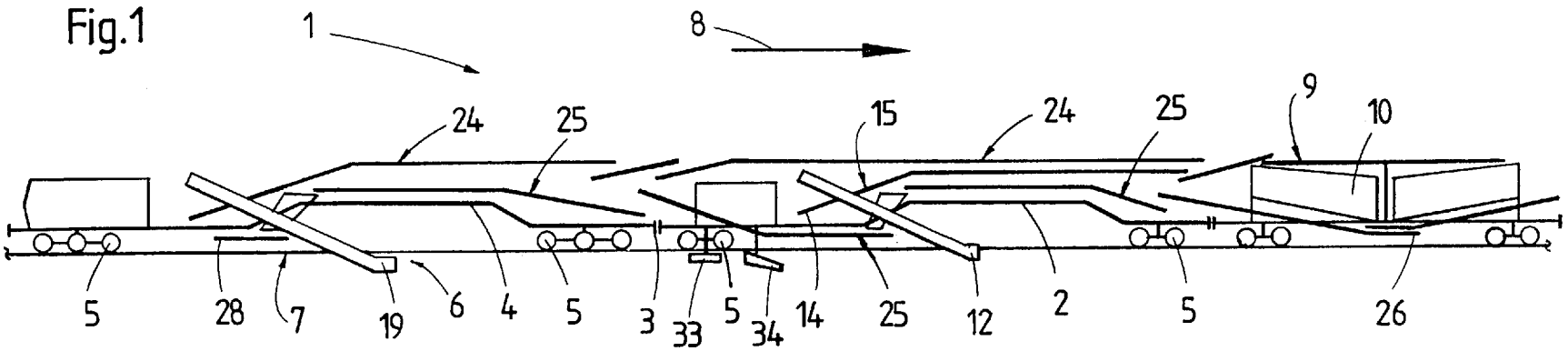
FIG. 1 is a schematic side elevational view of a ballast cleaning machine according to the present invention.
Figure 2:
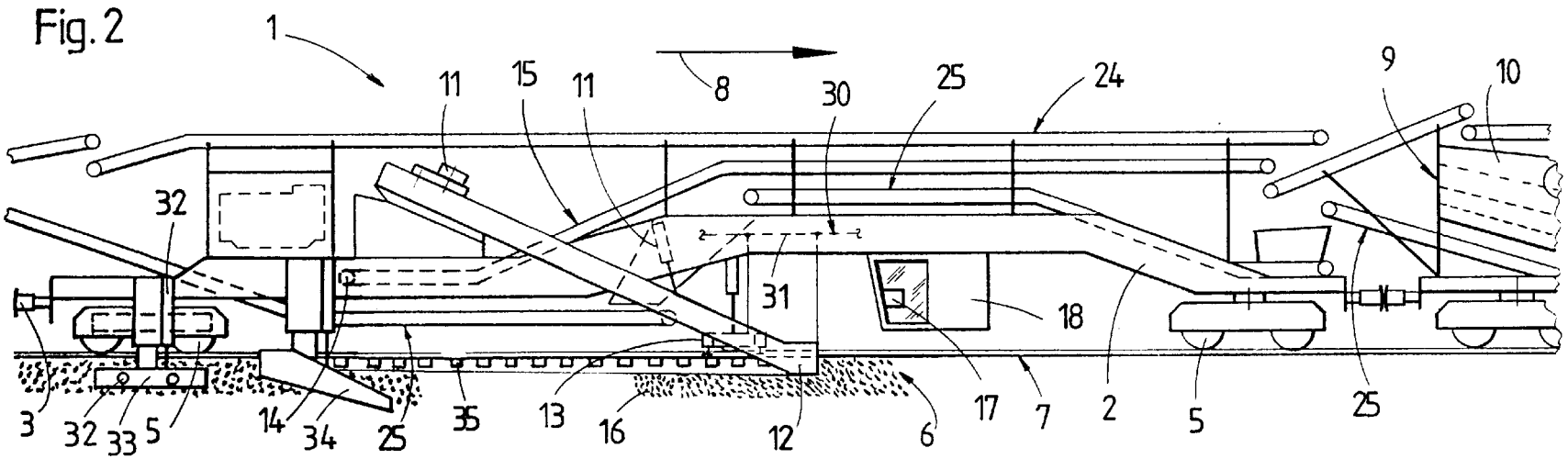
FIG. 2 is an enlarged side view of a front part of the machine.
Figure 3:
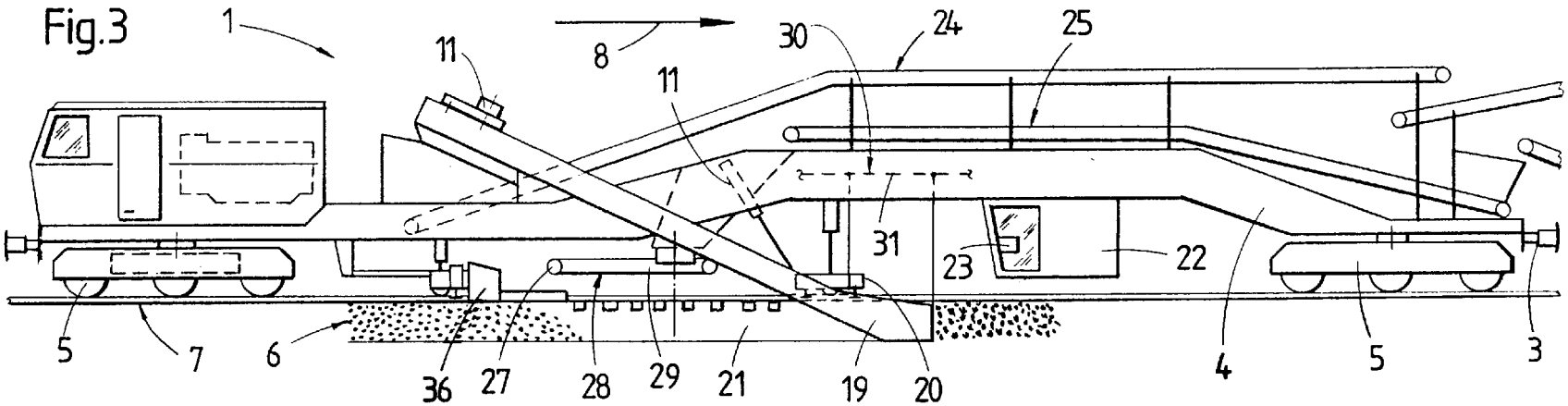
FIG. 3 is a like view of the rear part of the ballast cleaning machine.

The drawing shows machine 1 for cleaning ballast excavated from ballast bed 6 supporting track 7. The machine is movable on the track in an operating direction indicated by arrow 8. It comprises first machine frame 2 and second machine frame 4 trailing the first machine frame in the operating direction and linked thereto by articulated coupling 3. The ends of machine frames 2, 4 are supported on track 7 by undercarriages 5.

A first vertically and laterally adjustable endless excavating chain 12 is mounted on first machine frame 2 and passes underneath the track for excavating ballast 16. Such endless ballast excavating chains are conventional and comprise, as shown, a drive 11 for revolving the endless excavating chain and drive means 11' for vertically and laterally adjusting the endless excavating chain. A first track lifting device 13 is also mounted on first machine frame 2.

Similarly, a second vertically and laterally adjustable endless excavating chain 19, with drive 11 and drive means 11', is mounted on second machine frame 4 and passes underneath the track for excavating the ballast, and a second track lifting device 20 is mounted on the second machine frame. Track lifting devices 13 and 20 are arranged adjacent input ends of the endless ballast excavating chains where the chains dig into the ballast bed to excavate the ballast. Track lifting device 20 lifts and holds the track in short excavated ballast bed section 21.

Operator's cabs 18 and 22 are mounted on first and second machine frames 2 and 4 in front and within view of excavating chains 12 and 19, and controls 17 and 23 are arranged in the operator's cabs for adjusting the excavating chains.

A conventional screening installation 10 for cleaning the excavated ballast is mounted on a car 9 carrying the screening installation, car 9 preceding machine frames 2, 4 in the operating direction.

A first conveyor arrangement 15 is arranged to convey the excavated ballast from first excavating chain 12 to screening installation 10, and a second conveyor arrangement 24 is arranged to convey the excavated ballast from second excavating chain 19 to the screening installation. Ballast distributing device 28 is arranged at a trailing end of second machine frame 4 for distributing ballast cleaned on screening installation 10 to ballast bed 6, and a third conveyor arrangement 25 is arranged to convey the cleaned ballast from screening installation 10 to ballast distributing device 28. The third conveyor arrangement has a discharge end 27 behind second excavating chain 19 in the operating direction and an inlet end 26 arranged underneath screening installation 10 to receive the cleaned ballast from the screening installation. Ballast distributing device 28 is comprised of a conveyor band 29 which is pivotal about a vertical axis. A third track lifting device 36 is arranged immediately trailing discharge end 27 of the ballast distributing conveyor band.

To control the vertical and lateral adjustment of endless ballast excavating chains 12, 19 as well as track lifting devices 13, 20, reference systems 30 are mounted on first and second machine frames 2, 4 for establishing a reference basis 31 for obtaining a desired position of the adjustable endless excavating chains and the track. Such a reference system is known from U.S. Pat. No. 6,189,224, for example, and, therefore, requires no further description.

Vertically adjustable and vibratory ballast compacting devices 33 for compacting the ballast at the shoulders of the ballast bed are mounted on first machine frame 2 at a rear end thereof, where the machine frame is supported by undercarriage 5. Ballast plow 34 is arranged to move ballast towards ends 35 of ties supporting track 7 on ballast bed 6, the ballast plow preceding ballast compacting devices 33 in the operating direction.

The method for cleaning ballast excavated from ballast bed 6 supporting track 7 will now be described:

As ballast cleaning machine 1 continuously advances in the operating direction indicated by arrow 8, an upper layer of ballast bed 6 is excavated by first endless ballast excavating chain 12 in a first cleaning stage, the excavated ballast is conveyed by first conveyor arrangement 15 to screening installation 10 where it is cleaned. Track 7, which was lifted by track lifting device 13, is then lowered to lay on the remaining layer of ballast bed 6 so that undercarriages 5 may run on the track as the machine advances therealong. To stabilize the track temporarily before the cleaned ballast is distributed to the ballast bed, the ballast is moved by shoulder ballast plows 34 towards ends 35 of the track ties and compacted by ballast compactors 33.

In a second and trailing cleaning stage immediately following the first cleaning stage, track 7 is lifted by track lifting device 20 from the remaining layer of ballast bed 6, and this remaining ballast is excavated by second endless ballast excavating chain 19. The excavated ballast is conveyed by second conveyor arrangement 24 to screening installation 10 where it is cleaned. The ballast cleaned in the first and second cleaning stages is distributed by third conveyor arrangement 25 to the ballast bed at a rear end of ballast cleaning machine 1 where it is discharged from discharge end 27 before track 7 is lowered to lie on a cleaned ballast bed.

What is claimed is:

1. A machine for cleaning ballast excavated from a ballast bed supporting a track, the machine being movable on the track in an operating direction, which comprises (a) a first machine frame, (b) a second machine frame trailing the first machine frame in the operating direction and linked thereto, (1) the ends of the machine frames being supported on the track by undercarriages, (c) a first vertically and laterally adjustable endless excavating chain mounted on the first machine frame and passing underneath and around the track for excavating the ballast, (d) a first track lifting device mounted on the first machine frame, (e) a second vertically and laterally adjustable endless excavating chain mounted on the second machine frame and passing underneath and around the track for excavating the ballast, (f) a second track lifting device mounted on the second machine frame, (g) a screening installation for cleaning the excavated ballast, (h) a first conveyor arrangement for conveying the excavated ballast from the first excavating chain to the screening installation, (i) a second conveyor arrangement for conveying the excavated ballast from the second excavating chain to the screening installation, (j) a ballast distributing device arranged at a trailing end of the second machine frame for distributing ballast cleaned on the screening installation to the ballast bed, and (k) a third conveyor arrangement for conveying the cleaned ballast from the screening installation to the ballast distributing device, the third conveyor arrangement having (1) a discharge end behind the second excavating chain in the operating direction and (2) an inlet end arranged to receive the cleaned ballast from the screening installation.

2. The ballast cleaning machine of claim 1, further comprising a reference system mounted on the first and second machine frames for establishing a reference basis for controlling the adjustable endless excavating chains and the track lifting devices.

3. The ballast cleaning machine of claim 1, further comprising an operator's cab mounted on the first and second machine frames in front and within view of the excavating chains, and a control arranged in each operator's cab for adjusting the excavating chains.

4. The ballast cleaning machine of claim 1, further comprising a car carrying the screening installation, the car preceding the machine frames in the operating direction.

5. The ballast cleaning machine of claim 1, further comprising vertically adjustable and vibratory ballast compacting devices for compacting the ballast at the shoulders of the ballast bed, the ballast compacting devices being mounted on the first machine frame at a rear end thereof.

6. The ballast cleaning machine of claim 5, further comprising a ballast plow mounted on the first machine frame and arranged to move ballast towards ends of ties supporting the track on the ballast bed, the ballast plow preceding the ballast compacting devices in the operating direction.

7. A method for cleaning ballast excavated from a ballast bed supporting a track, which comprises (a) a first cleaning stage wherein an upper layer of the ballast bed is excavated, the excavated ballast is cleaned and the track is lowered to lay on the remaining layer of the ballast bed, (b) a second and trailing cleaning stage immediately following the first cleaning stage, wherein the track is lifted, the ballast of the remaining layer of the ballast bed is excavated and the excavated ballast is cleaned, and (d) the ballast cleaned in the first and second cleaning stages is distributed to the ballast bed before the track is lowered to lay on a cleaned ballast bed.

8. The ballast cleaning method of claim 7, comprising the step of temporarily stabilizing the track before the cleaned ballast is distributed to the ballast bed by compacting the ballast at ends of ties supporting the track on the ballast bed.

* * * * *